United States Patent [19]

Brigida et al.

[11] 4,381,817

[45] May 3, 1983

[54] WET/DRY STEAM CONDENSER

[75] Inventors: Carlo J. Brigida, Convent Station; William J. Bow, Morristown, both of N.J.

[73] Assignee: Foster Wheeler Energy Corporation, Livingston, N.J.

[21] Appl. No.: 258,137

[22] Filed: Apr. 27, 1981

[51] Int. Cl.[3] ..... F28B 1/02; F28B 1/06

[52] U.S. Cl. ..... 165/110; 62/305; 62/310; 165/DIG. 1

[58] Field of Search ..... 165/110, DIG. 1; 261/153, DIG. 11; 62/305, 310

[56] References Cited

U.S. PATENT DOCUMENTS 3,885,936 5/1975 Limebeer ..... 261/DIG. 11

3,887,666 6/1975 Heller et al. ..... 261/DIG. 11

4,149,588 4/1979 Waters ..... 165/110 X 4,226,282 10/1980 Kunzagi et al. ..... 165/110 X

*Primary Examiner*—Albert W. Davis, Jr.

*Attorney, Agent, or Firm*—Marvin A. Naigur; John E. Wilson; Warren B. Kice

[57] ABSTRACT

A wet/dry steam condenser in accordance with the present invention includes two spaced-apart, vertically aligned groups of heat pipes with each group having the lower, evaporator sections of their respective heat pipes exposed to the interior of an associated, longitudinally extending steam-receiving plenum. The upper, condensing section of each heat pipe is provided with fin structures and can be selectively cooled by a fan-induced air flow and/or deluge water supplied from either a flood water trough and/or a spray-head assembly.

8 Claims, 3 Drawing Figures

WET/DRY STEAM CONDENSER

BACKGROUND OF THE INVENTION

The present invention relates to wet/dry steam condensers and, more particularly, to steam condensers which utilize heat pipes having an evaporator section exposed to the steam to-be-condensed and a condensing section cooled by either a cooling air-flow and/or a cooling water-flow.

In the steam power generation cycle, the exhaust steam from the turbine(s) is generally passed through one or more surface-type heat exchanging condensers to remove the heat energy from the steam and effect condensation. A variety of heat exchanging condensers, including the wet-type, the dry-type, and combinations thereof, are known for effecting steam condensation wherein the ultimate heat sink is the atmosphere. In the wet-type, the steam is passed along one side of a heat transfer surface, such as the wall section of a tube, and a heat receiving fluid (e.g. water) is passed along the other side. In the dry-type, air, rather than water, is passed over the heated surface to absorb the heat from the steam. The heated surfaces of the dry-type condenser generally include fins or fin-like structures that increase the heat transfer characteristics and the efficiency of the condenser. In the combined-type of steam condenser, heat energy from the steam may be selectively transferred to the air, and/or water.

Water and air, when used as the heat receiving fluids, each possess certain drawbacks which can hinder the efficient condensation of steam. For example, the quantity of water required by wet-type heat exchangers can be quite large, and, occasionally, water in sufficient quantities and of a minimum acceptable quality may not be available on a consistent year-round basis. Also, the water is heated as it passes through the heat exchanger, and the heated water can cause thermal pollution when it is returned to the environment. Air, while abundantly available, has a low heat capacity, density, and heat transfer rate and requires the use of large, power-consuming fans to create the cooling air flows.

In the past, efforts have been made to increase steam condenser efficiency by fabricating condensers using heat pipes or thermal siphons. These condensers have included a plurality of heat pipes having their lower, evaporator sections exposed to the steam to-be-condensed and their upper, condenser sections exposed to an ambient, cooling air-flow. While heat-pipe steam condensers are effective, their overall heat transfer rates in relation to their capital cost have yet to be optimized.

SUMMARY OF THE INVENTION

In view of the problems associated with conventional steam condensers and the heat transfer advantages associated with heat pipes, it is a broad, overall object, among others, of the present invention to provide a steam condenser suitable for use in steam power-generating cycles in which the heat energy in the steam is quickly transferred from the steam to a heat receiving fluid via heat pipes.

It is another object of the present invention to provide a steam condenser in which the heat energy in the steam is quickly transferred from the steam and selectively transferred to a cooling air-flow and/or a cooling water-flow.

In accordance with these objects, and others, the present invention provides a steam condenser which includes a plurality of substantially vertically aligned heat pipes preferably arranged in spaced-apart row formations in which the lower, evaporator sections of each heat pipe is exposed to the interior of a steam-receiving plenum. The upper portion of each heat pipe above the steam plenum is provided with fin structures to enhance the heat transfer efficiency of the condenser. The heat energy removed from the steam may be selectively transferred to a fan-induced cooling air-flow or cooling water supplied by a cooling water system that includes flood water troughs and spray head assemblies.

The heat energy is the steam is quickly transferred from the steam in the steam plenum to the upper portions of the heat pipes where the heat energy is conducted through the wall of the heat pipes and transferred to either the cooling water flow and/or the cooling air flow.

BRIEF DESCRIPTION OF THE DRAWINGS

The above description, as well as the objects, features, and advantages of the present invention will be more fully appreciated by reference of the following detailed description of a presently preferred but nonetheless illustrative embodiment in accordance with the present invention, when taken in conjunction with the accompanying figures in which.

DESCRIPTION OF THE PREFERRED EMBODIMENT

Figure 1:
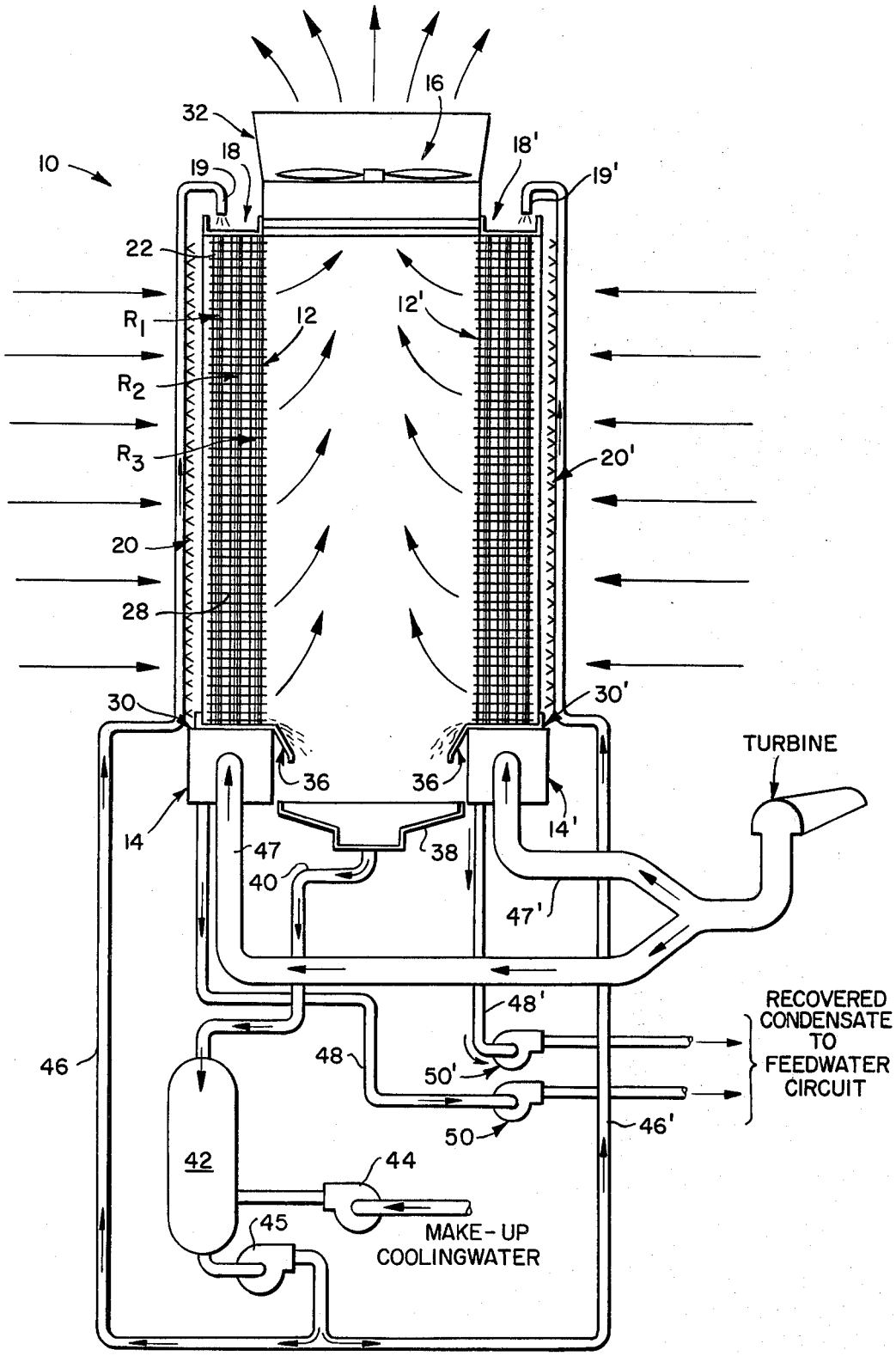
FIG. 1 is a front-elevational view of a wet/dry steam condenser in accordance with the present invention.
Figure 2:
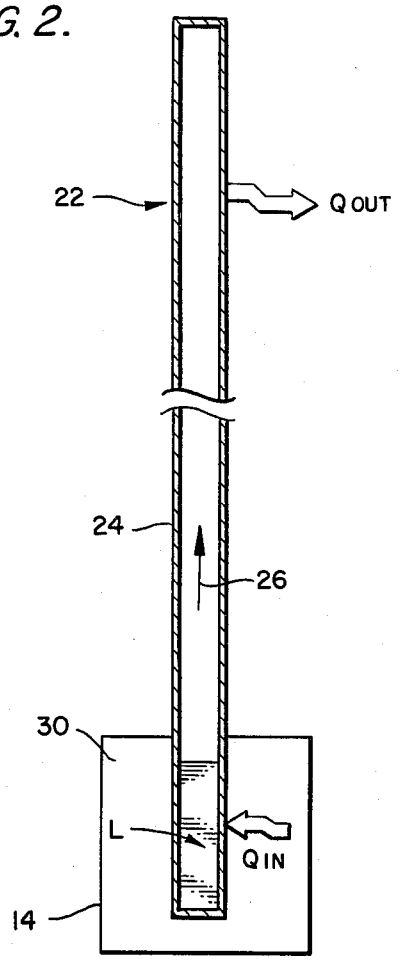
FIG. 2 is an enlarged elevational view, in cross-section, of a typical heat pipe utilized in the steam condenser of FIG. 1.

A wet/dry steam condenser in accordance with the present invention is generally represented by the reference character 10 in the figures and includes, as shown in FIG. 1, two, spaced-apart heat-pipe groups 12 and 12', steam plenums 14 and 14', a cooling air fan 16, and a cooling water deluge system which includes flood water troughs 18 and 18' and spray-head assemblies 20 and 20'. The heat pipe groups 12 and 12' are each formed from a plurality of substantially vertically aligned heat pipes 22 which may be conveniently arranged in three paralleled rows, $R_1$, $R_2$, and $R_3$, as shown in FIG. 1. The heat pipes 22 are of conventional design in that they are fabricated, as shown in FIG. 2, from straight, hollow tubes 24 which are sealed at both ends. Each tube 24 contains a selected quantity of heat transfer liquid L (e.g. ammonia) at a selected vapor pressure. The liquid L collects in the lower portion of each tube 24, termed the evaporator section, and is adapted to vaporize in response to heat energy ($Q_{in}$) introduced into the evaporator. The vapor rises upwardly in the tube 24, as indicated by the arrow 26 in FIG. 2, and condenses in the upper condenser portion of each tube, relinquishing its heat energy ($Q_{out}$), with the condensate falling under the influence of gravity to the evaporator section.

Referring again to FIG. 1, the upper portion of each heat pipe 22 is provided with a plurality of fins extending outwardly of the tube surfaces to provide an extended heat transfer surface. The fins, which are schematically represented in FIG. 1 by the vertically spaced, horizontal lines 28, may take any one of a number of surface configurations including spines, longitudinal fins, spiral fins, or disc-like fins. The lower portion of each heat pipe 22 passes through an upper surface 30 of the box-like, longitudinally extending steam-receiving plenums 14 and 14'.

The horizontally disposed fan 16 spans the space between the two heat-pipe groups 12 and 12' and serves to induce a cooling air-flow by drawing ambient air laterally inward from the sides of the groups and directing the air upwardly through an exhaust hood 32 as shown by the air-flow arrows in FIG. 1.

The cooling-water deluge system is designed to selectively augment the cooling effect provided by the fan 32. The flood water troughs 18 and 18' are located near the upper end of the heat-pipe groups 12 and 12' respectively, with each trough having a plurality of thru-openings designed to accommodate the heat pipes 22. The openings are somewhat larger than the outside diameter of the heat pipes 22 such that water entering the flood water troughs 18 and 18' from water supply spouts 19 and 19' will cascade downwardly along the outside surface of the heat pipes and fin structures 28 to remove heat energy. The spray head assemblies 20 and 20' are located laterally adjacent the heat-pipe groups 12 and 12', respectively, and are adapted to direct a water spray along the entire vertical length of the heat pipes 22 in order to increase the overall supply of cooling water. While the spray head assemblies 20 and 20' have been shown located on the outside of the heat-pipe groups 12 and 12', respectively, and facing inwardly, they may be located in other positions and may, if preferred, be divided into spray head sub-assemblies. Control valves (not shown) are provided to enable independent operation of the flood water troughs 18 and 18' or the spray head assemblies 20 and 20'.

A water-receiving spill-way 36 is mounted on the upper surface of each steam plenum 14 and 14' and functions to collect the cooling water as it drains from the heat pipes 24 and direct the water into a collecting basin 38 located between the plenums. The cooling water in the basin 38 flows through a pipe 40 into a water treatment unit 42 which also receives make-up cooling water supplied through a pump 44 and which serves to maintain the quality of the cooling water by removing impurities. After the water is treated, it is recycled through a pump 45 and conduits 46 and 46' having control valves (not shown) to the flood water troughs 18 and 18' and the spray head assemblies 20 and 20'.

As shown in FIG. 1, the condenser 10 is adapted to accept and condense steam exhausted from, e.g., a steam turbine. The exhaust steam is divided into two flows that are directed via conduits 46 and 46' to the steam plenums 14 and 14'. The presence of the steam in the plenums 14 and 14' causes the heat pipes 22 to initiate and maintain their vaporization/condensation cycle to remove heat from the steam and effect condensation. The condensate is collected in the lower portions of each plenum 14 and 14' and removed through the condensate recovery conduits 48 and 48'. Pumps 50 and 50' assist in returning the recovered condensate to the feed-water circuit.

Figure 3:
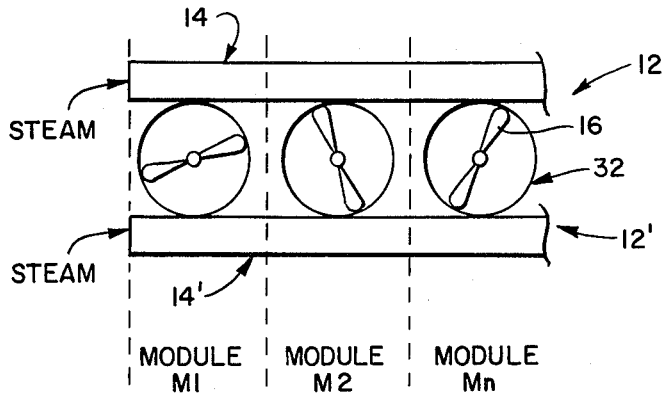
FIG. 3 is a reduced plan view of a portion of the steam condenser of FIG. 1 in accordance with the present invention.

The steam condenser 10 of the present invention is preferably configured in modular form with the modules $M_1$, $M_2$, . . . $M_n$, as illustrated in FIG. 3, lineally connected together to form a complete steam condensing system. An exemplary steam condenser, designed to condense steam from a large steam turbine, would include two, parallel steam-plenums approximately 460 ft. (140 m.) long with 6,000 heat pipes (50 ft.) extending upwardly from each plenum. Eighteen 32-ft. diameter fans, each of which defines a steam condensing module, are equally distributed along the length of the plenums and provide the cooling air flow. Depending upon the ambient air temperature and air flow, one or more of the fans are turned-on to provide the required amount of induced cooling air-flow. At a predetermined threshold temperature, e.g. 55° F. (10° C.), the deluge water system for one or more modules may be turned-on to increase the heat transfer from the heat pipes.

As will be apparent to those skilled in the art, various changes and modifications may be made to the apparatus of the present invention without departing from the spirit and scope of the present invention as recited in the appended claims and their legal equivalent.

What is claimed:

1. A wet/dry steam condensing apparatus comprising:

a plurality of substantially vertically aligned heat pipes, each of said heat pipes having a lower, evaporator section and an upper, condensing section and containing a selected quantity of a heat transfer fluid adapted to transfer heat energy from said evaporator section to said condensing section through a vapor/condensation cycle;

a steam receiving plenum adapted to receive steam from a steam source, at least a portion of said evaporator sections of said heat pipes passing through a surface portion of said plenum for exposure to the steam;

each of said heat pipes having a finned portion;

a flood water trough adapted to selectively receive cooling water and flow the water downwardly onto the finned surfaces of said heat pipes; and a plurality of spray heads adapted to direct a spray of cooling water onto said heat pipes.

2. The wet/dry steam condensing apparatus claimed in claim 1 wherein:

said heat pipes are arranged in two spaced-apart heat pipe groups, each of said groups associated with a steam plenum.

3. The wet/dry steam condensing apparatus claimed in claims 1 or 2 further comprising:

fan means adapted to induce a flow of cooling air across said finned portions.

4. The wet/dry steam condensing apparatus of claim 3 wherein a single fan is associated with two corresponding heat pipe groups.

5. The wet/dry steam condensing apparatus claimed in claim 3 further comprising:

a hood assembly adapted to direct the cooling air flow from said fan means.

6. The wet/dry steam condensing apparatus claimed in claim 1 wherein:

said apparatus is arranged in modular form, each of said modules adapted to be connected to one another to constitute a steam condensing system.

7. The wet/dry steam condensing apparatus claimed in claim 1 comprising:

a water receiving spill-way positioned relative to said heat pipes to receive at least a portion of the water applied to said heat pipes by said cooling water application means.

8. The wet/dry steam condensing apparatus claimed in claim 7 further comprising:

a cooling water recycling system including a water treatment unit adapted to receive water from said spill-way and return said water to said cooling water applications means.

* * * * *